US005573053A

United States Patent [19]

Hanemaayer

[11] Patent Number: 5,573,053

[45] Date of Patent: Nov. 12, 1996

[54] COMBINATION SWING AND SLIDE TRI-FOLD DOOR SYSTEM FOR RECREATIONAL VEHICLES OR THE LIKE

[75] Inventor: Jacobus N. Hanemaayer, Kitchener, Canada

[73] Assignee: Hanmar Motor Corporation, Ontario, Canada

[21] Appl. No.: 494,967

[22] Filed: Jun. 26, 1995

[30] Foreign Application Priority Data

Jul. 14, 1994 [CA] Canada ..... 2128041

[51] Int. Cl.[6] ..... E05D 15/26

[52] U.S. Cl. ..... 160/206; 296/146.13

[58] Field of Search ..... 160/213, 210, 160/199, 206, 185; 296/146.12, 146.13, 146.4, 164

[56] References Cited

U.S. PATENT DOCUMENTS

| | | | |
|---|---|---|---|
| 1,750,989 | 3/1930 | Bradfield | 160/199 |
| 3,610,313 | 10/1971 | Friedrich | 160/206 |
| 3,911,831 | 10/1975 | Blunden | 160/213 X |
| 4,589,463 | 5/1986 | Ryan | 160/210 X |
| 5,186,230 | 2/1993 | Ostrander | 160/199 X |

*Primary Examiner*—David M. Purol

*Attorney, Agent, or Firm*—Killworth, Gottman, Hagan & Schaeff

[57] ABSTRACT

A tri-fold door system including a pair of spaced uprights defining a door opening, and a door including three vertically oriented panels namely, a distal panel, an intermediate panel and a proximal panel. These panels are hinged together for movement relative to one another from a door closed position wherein the panels are in the plane of the door opening to a door open position wherein the panels lie folded in close juxtaposition to each other. The proximal panel is hinged to a first one of the uprights defining the door opening. A track-way extends from the other one of the uprights part-way toward the first upright and is adapted to receive and guide the distal panel in a path lying in the plane of the door opening away from or toward the other one of the uprights as the door is being opened or closed respectively. At the same time the remaining two panels pivot relative to one another between positions which are co-planar relative to each other and folded positions in close juxtaposition with each other.

14 Claims, 5 Drawing Sheets

COMBINATION SWING AND SLIDE TRI-FOLD DOOR SYSTEM FOR RECREATIONAL VEHICLES OR THE LIKE

BACKGROUND OF THE INVENTION

This invention relates to improvements in door systems and in particular to a combination swing and slide tri-fold door system (especially a screen door system) for recreational vehicles or the like.

There are many types of recreational vehicles and the present invention is particularly applicable to, although not limited to, camper van conversions which involve the conversion of a commercial cargo van. These camper van conversions are officially known in the industry as Class B recreational vehicles. These commercial cargo vans are available in several different sizes but regardless of the van size it is important that the limited space available be used in the most efficient manner.

Screen door systems for such camper van conversions present special problems. In many cases obstructions are present or there is insufficient room to accommodate an inwardly swinging single panel full width screen door. A single panel sliding door frequently cannot be used as there is no space available to slide it into due to doors, windows, or other items on both sides of the door opening.

The prior art has provided several types of screen doors in addition to the common swing and sliding types noted above. Screens which roll up either to the top or to the side of the door opening or ones that slide into a pocket have been used from time to time. There is also a type of screen that is held by "Velcro" around the door opening and which has a zipper in the centre. There is another type which simply overlaps by a certain degree in the centre. The zipper-type is inconvenient to use and the overlap type is often not very effective in keeping insects out as it does not always fall tightly into place by itself after entering or exiting, thus leaving a space for insects to enter freely.

OBJECTS AND SUMMARY OF THE INVENTION

The principal object of the invention is to provide a door system, particularly a screen door system, which is effective in keeping insects out and which is as easy to open and close with one hand within the same time span as is a swinging or sliding door.

It is a further objective to provide a screen door system which is out of the way when open so that it does not have to be opened and closed when not required to keep insects out and which screen door stays tightly closed by itself after use without latching or locking it every time.

Thus, in accordance with the invention in one aspect there is provided a tri-fold door system comprising a pair of spaced uprights defining a door opening, and a door including three vertically oriented panels namely, a distal panel, an intermediate panel and a proximal panel. These panels are hinged together for movement relative to one another from a door closed position wherein said panels are in the plane of the door opening to a door open position wherein said panels lie folded in close juxtaposition to each other. The proximal panel is hinged to a first one of said uprights defining said door opening. A track-way extends from the other one of said uprights part-way toward said first upright and is adapted to receive and guide said distal panel in a path lying in the plane of the door opening away from or toward said other one of the uprights as the door is being opened or closed respectively. At the same time the remaining two panels pivot relative to one another between positions which are co-planar relative to each other and folded positions in close juxtaposition with each other.

In a further aspect of the invention said trackway terminates sufficiently distant from said first one of said uprights such that said distal panel can be swung clear of said trackway and folded into close parallelism with the remaining two panels and vice versa as the door is being opened closed respectively.

A further feature of the invention is a bi-stable mechanism to assist in maintaining said panels in the door open and door closed positions. This mechanism preferably includes a compression spring activated toggle.

In its preferred form the tri-fold door system comprises part of a recreational vehicle with the door being a screen door.

Still further according to an aspect of the invention said first one of said uprights comprises a partition extending inwardly of the vehicle interior from the door opening and wherein said panels lie in close parallelism with said partition when in the door open position.

In a preferred form of the invention, certain of said door panels have flattened handles to assist in pushing and pulling of the panels without interfering with their movement into close juxtaposition with each other.

Further features and advantages of the invention will become apparent from the description of a preferred embodiment which follows hereafter.

BRIEF DESCRIPTION OF THE VIEWS OF DRAWINGS

DETAILED DESCRIPTION OF THE PREFERRED EMBODIMENT

Figure 1:
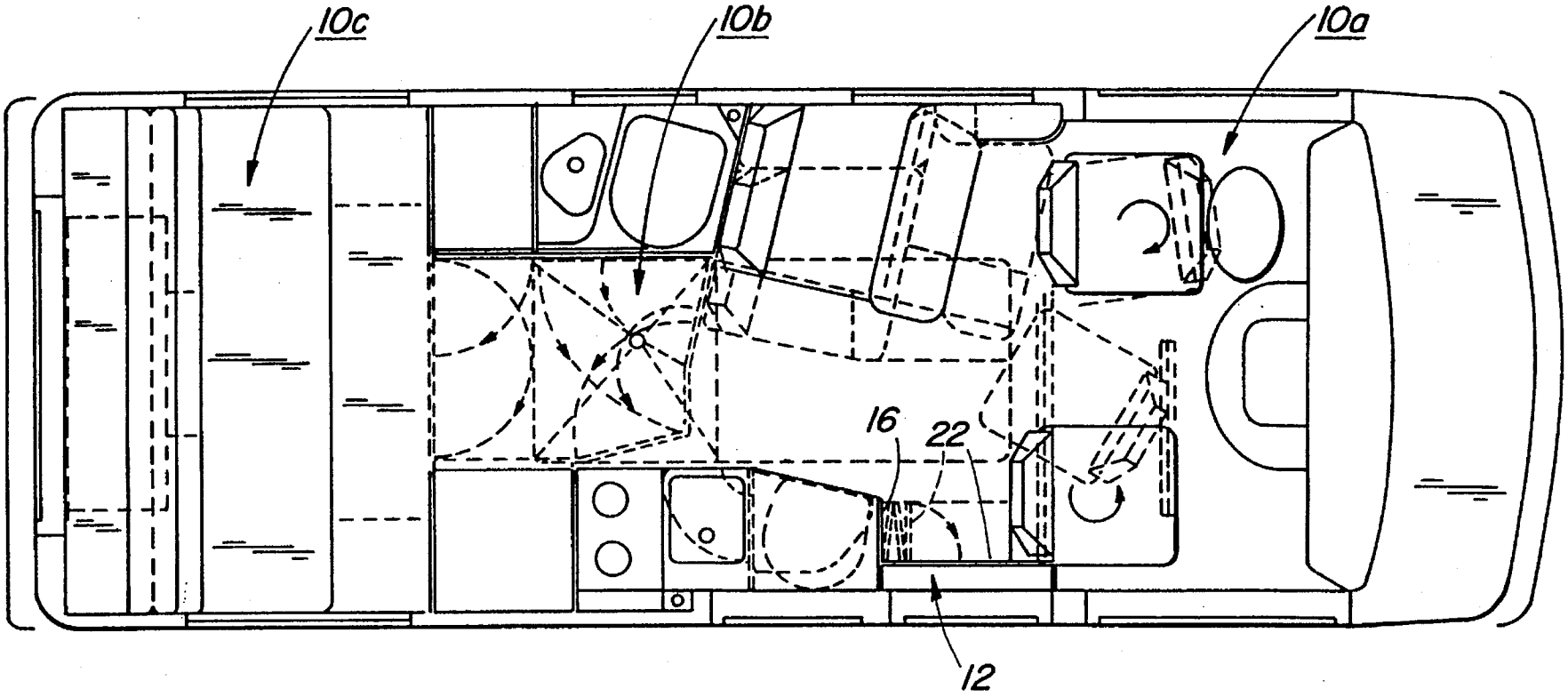
FIG. 1 is a top plan view of the interior of a recreational vehicle incorporating the tri-fold screen door of the present invention.

Referring to FIG. 1, the recreational vehicle interior is shown as including a forwardly disposed seating area **10*a* which may be converted to a dinette for two and/or four persons and also to a single and/or double bed as fully described in my copending Canadian application Ser. No. 2,125,531 filed Jun. 9, 1994. The vehicle also is shown as including a centrally located utility region 10***b* incorporating kitchen and toilet facilities which may be segregated to provide a central privacy area as more fully described and claimed in my Canadian Patent No. 1,200,262 issued Feb. 4th, 1986. The rearward region 10*c* of the van interior is shown as including a rear seating assembly which is convertible to a double and/or king-size T-shaped bed. The structures and facilities within this rear section 10*c* are described in full detail in my co-pending Canadian application Ser. No. 2,128,040 filed Jul. 14, 1994.

With continued reference to FIG. 1, a tri-fold door system 12 in accordance with the preferred embodiment of the invention is disposed at the one side of the vehicle intermediate the front seating area 10*a* and the central utility area 10*b*. This door system 12 includes a door opening 14 defined by a pair of spaced uprights, a first one of these uprights comprising a vertical partition 16 extending inwardly of the vehicle interior a short distance from the door opening while the second upright (which extends outwardly from the door opening 14 to the main vehicle door opening at the exterior surface of the vehicle) is spaced therefrom and includes a door stop 18 having a suitable angle lip 20 thereon to prevent entry of insects when the door is in the closed position.

Figure 2:
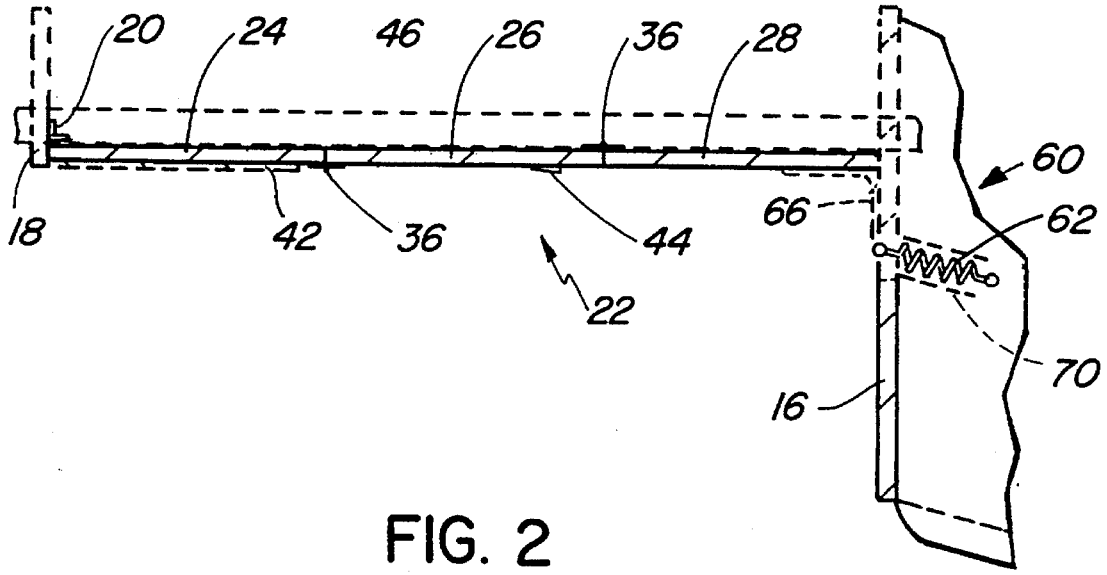
FIG. 2 is a top plan view of the combination swing and slide tri-fold screen door in the closed position.
Figure 6:
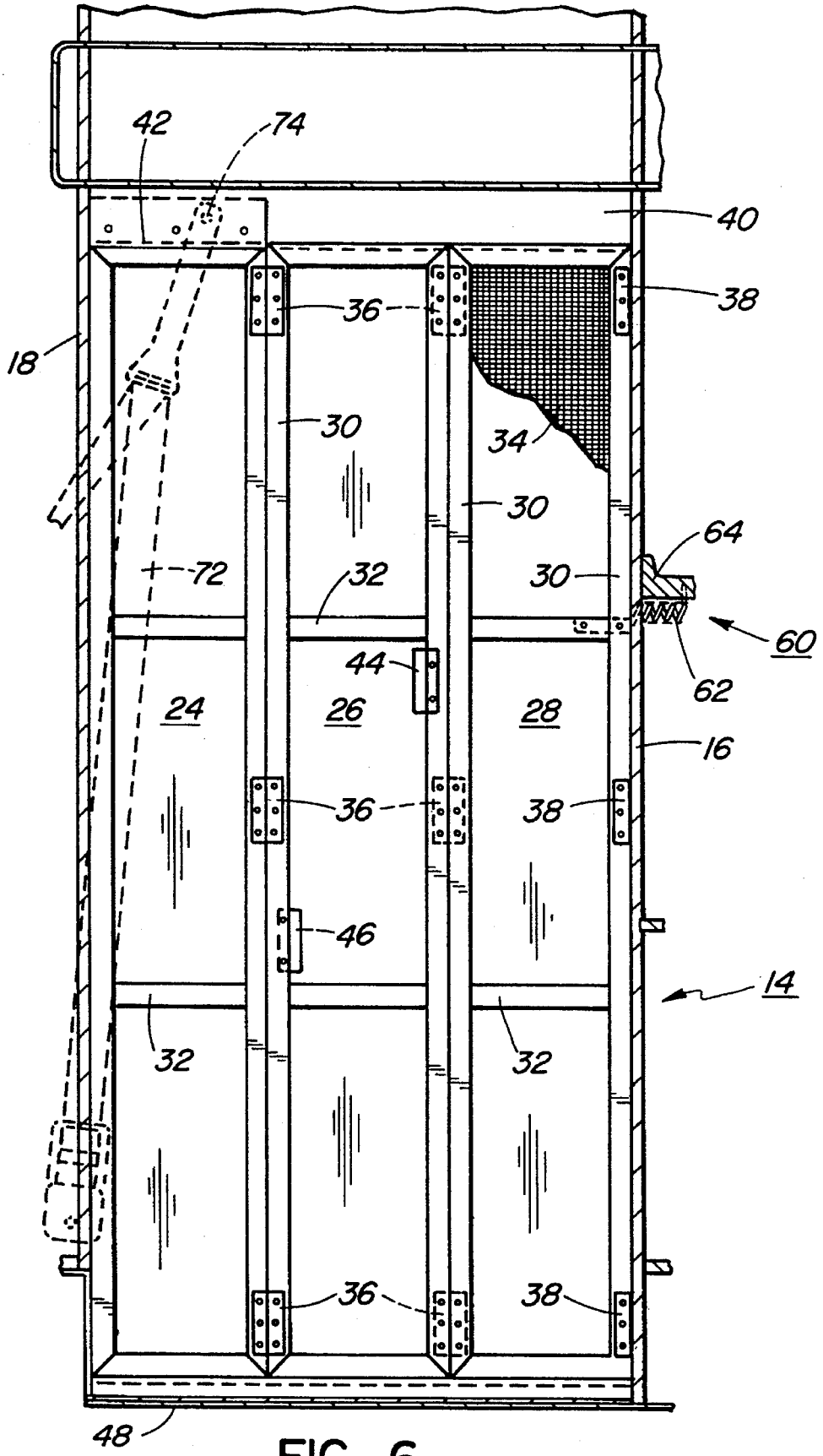
FIG. 6 is an elevation view of the door in a closed position, as seen from the van interior, with the shoulder safety belt (shown in phantom) stretched across the left upper corner down to the floor.

With reference to FIG. 6, the tri-fold door 22 includes three vertically oriented panels namely, a distal panel 24, an intermediate panel 26 and a proximal panel 28. Each panel includes an elongated rectangular marginal frame 30, each frame having a pair of vertically spaced cross members 32 therein to provide additional strength and rigidity. A suitable screening material 34 is supported by each of the marginal frames 30 in a conventional manner which need not be described further here. The above-noted panels 24, 26, 28 are hinged together by way of hinges 36 for movement relative to one another from a door closed position (see FIGS. 2 and 6) wherein the door panels 24, 26, 28 lie in the plane of the door opening, to a door open position (see FIG. 3) wherein these panels lie folded in close juxtaposition to each other.

As shown in any of FIGS. 2–6, the proximal panel is hinged by hinges 38 to the vertical partition 16 which defines one side of the door opening. An overhead header 40 extends between the partition 16 and the previously mentioned door stop 18 which defines the opposing side of the door opening. A shallow groove-defining track-way 42 (FIGS. 2–5) is supported from the header 40 and extends from the door stop 18 part way (approximately ⅓ of the way) toward the partition 16. This track-way 42 is adapted to receive and guide the distal panel 24 in a straight-line path lying in the plane of the door opening away from or toward the door stop 18 as the door 22 is being opened or closed respectively. At the same time as the door 22 is being opened or closed, the remaining two panels 26, 28 pivot relative to one another between positions which are co-planar relative to each other (see FIG. 2) and folded positions in close parallel juxtaposition with each other (see FIGS. 3–5).

Figure 7:
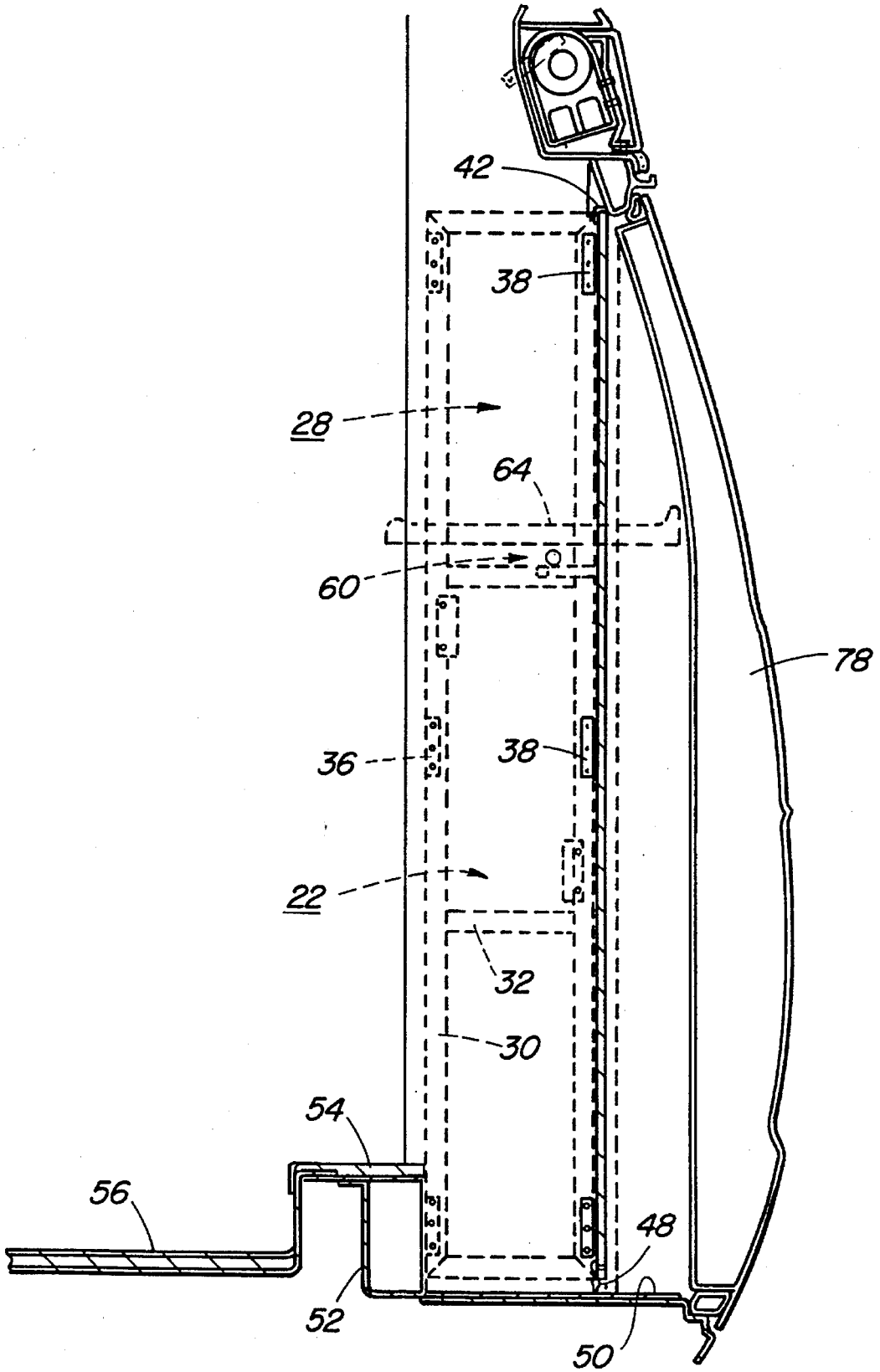
FIG. 7 is a cross-section taken through the van side wall rearwardly of the door showing the door in a closed position in solid lines and in dashed lines in the open position.

The tri-fold screen door 22 is opened and closed by pulling and pushing, respectively, on a handle 44 on the inside of the door and on another handle 46 on the outside which for convenience is located somewhat lower than the inside handle. A rubber door sweep 48 (FIGS. 6 and 7) closes any gap between the bottom of the tri-fold door 22 and the vehicle step 50 (FIG. 7).

It might also be noted here that the chassis rail 52 (FIG. 7) limits the width of the tri-fold screen door panels 24, 26, 28. To enter, one would step on the lower vehicle step 50 and on or over chassis rail 52 and the floor 54 and onto the dropped floor 56 provided in the central area of the van.

A bi-stable mechanism 60 is provided for maintaining the tri-fold door 22 in the door open and door closed positions. This mechanism includes a compression spring 62 which is fastened at one end to any convenient shelf or horizontal surface, in this case to the bottom of the kitchen counter 64 (which in this case is located immediately adjacent the above-noted partition 16) while the other end of the compression spring 62 is fastened to the end of a bracket 66. The bracket is fastened to a door cross-member 32 and the adjacent marginal frame 30 of the proximal door panel 28. A slot 68 of a size sufficient to accommodate the bracket 66 is provided in the vertical partition 16 and this slot 68 allows the bracket 66 to move freely through the slot when the proximal panel 28 pivots back and forth as the tri-fold screen door 22 is moved between the opened and closed positions. In the course of this movement, the compression spring 62 toggles back and forth as the tri-fold screen door 22 is opened and closed and this keeps the door firm in both open and closed positions. In order to keep the compression spring 62 from buckling, the spring is provided with an enclosure tube 70 (shown in dashed lines) which tube is of a length approximately equal to the length of the spring 62 when fully compressed during the course of the toggle action described above.

Figure 5:
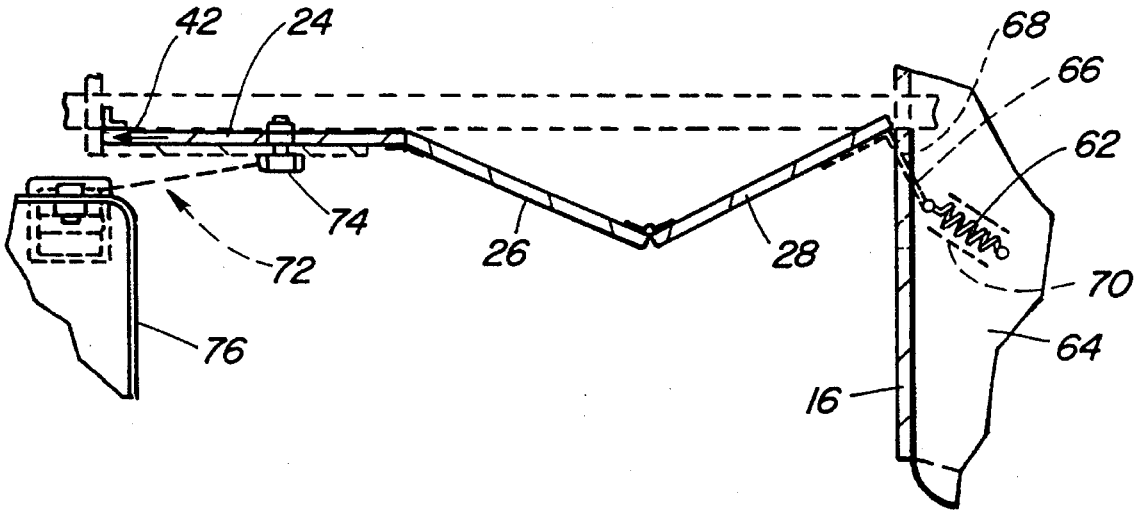
FIG. 5 is a top plan view with the door almost closed, showing how it enters the track, which is located between the shoulder safety belt at the top and header of the door opening, a shoulder belt anchorage at the seat base floor level being shown at the left.

FIGS. 5 and 6 additionally show a shoulder/lap safety belt 72 fastened at the top by a bolt 74 in the header of the door opening a certain distance in from the partition thereby partially blocking the upper corner of the door opening. The lower end of the shoulder/lap safety belt 72 is fastened on the seat base 76 near the floor level. The blocking of the door opening upper front corner by the shoulder/lap belt 72 would prevent a conventional screen door from swinging inwardly. However, the straight line sliding action of the distal panel 24 overcomes this problem. Also, those skilled in the art will realize that a single panel sliding door could not be used in this situation as there would be no space to slide it into owing to doors, windows and other items on both sides of the door opening.

With reference again to FIG. 7 it will be seen that it is difficult to install a folding door in the same alignment as the curved exterior door 78. To fit a rigid but curved single panel door swinging outwardly in a curved wall is not nearly as practical as the above-described tri-fold door 22 with its unique sliding, pivoting and inwardly folding action. To install a curved single panel screen door on a door opening of a commercial van would involve a real problem insofar as hinging and fitting are concerned as the door opening was not designed for that purpose. On the other hand, a tri-fold screen door 22 as described above can be installed very easily and made from readily available standard stock materials.

Figure 3:
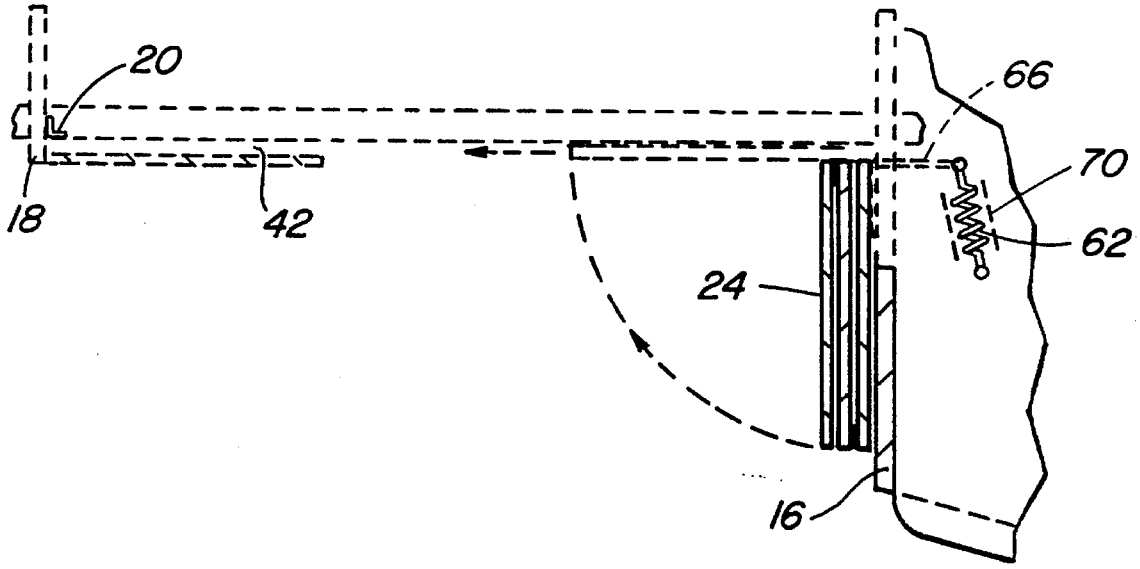
FIG. 3 is a top plan view with the door shown in an open position and held against an interior partition.
Figure 4:
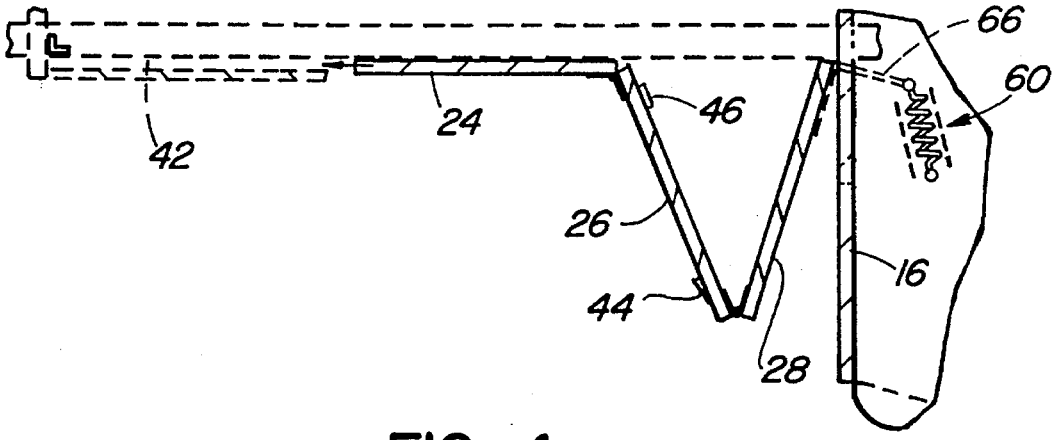
FIG. 4 is a top plan view with the door in a partially closed position.

As will be appreciated from the above, the tri-fold screen door 22 is very light and easy to open and close and when no insects are present and the screen door is not required, it is moved to the full opened position as illustrated in FIG. 3 where it is entirely out of the way until such time as it is again needed.

A preferred embodiment of the invention has been described by way of example. Those skilled in the art will realize that various modifications and changes may be made while remaining within the spirit and scope of the invention.

Hence the invention is not to be limited to the embodiment as described but, rather, the invention encompasses the full range of equivalencies as defined by the appended claims.

I claim:

1. A tri-fold door system comprising a pair of spaced uprights defining a door opening, and a door including three vertically oriented panels which are, a distal panel, an intermediate panel and a proximal panel, said panels being hinged together for movement relative to one another from a door closed position wherein said panels lie in the plane of the door opening to a door open position wherein said panels are folded in close juxtaposition to each other, said proximal panel being hinged to a first one of said uprights defining said door opening, a track-way extending from the other one of said uprights part-way toward said first upright and adapted to receive and guide said distal panel in a path lying in the plane of the door opening away from or toward said other one of the uprights as the door is being opened or closed respectively while the remaining two panels pivot relative to one another between positions which are co-planar relative to each other and folded positions in close juxtaposition with each other.

2. The door system of claim 1 wherein said trackway terminates sufficiently distant from said first one of said uprights such that said distal panel can be swung clear of said trackway and folded into close parallelism with the remaining two panels as the door is being opened.

3. The door system of claim 1 further including a bi-stable mechanism to assist in maintaining said panels in the door open and door closed positions.

4. The door system of claim 2 further including a bi-stable mechanism to assist in maintaining said panels in the door open and door closed positions.

5. The door system of claim 3 wherein said bi-stable mechanism comprises a compression spring activated toggle.

6. The door system of claim 1 wherein said tri-fold door system comprises part of a recreational vehicle.

7. The door system of claim 2 wherein said tri-fold door system comprises part of a recreational vehicle.

8. The door system of claim 3 wherein said tri-fold door system comprises part of a recreational vehicle.

9. The door system of claim 6 wherein said first one of said uprights comprises a partition extending inwardly of the vehicle interior from the door opening and wherein said panels lie in close parallelism with said partition when in the door open position.

10. The door system of claim 1 wherein said door is a screen door.

11. The door system of claim 6 wherein said door is a screen door.

12. The door system of claim 1 wherein at least one of said door panels has flattened handles to assist in pushing and pulling of the panels without interfering with their movement into close juxtaposition with each other.

13. The door system of claim 2 wherein at least one of said door panels has flattened handles to assist in pushing and pulling of the panels without interfering with their movement into close juxtaposition with each other.

14. The door system of claim 9 wherein at least one of said door panels has flattened handles to assist in pushing and pulling of the panels without interfering with their movement into close juxtaposition with each other.

* * * * *